US010595613B1

(12) United States Patent
Morales

(10) Patent No.: US 10,595,613 B1
(45) Date of Patent: Mar. 24, 2020

(54) LOTION APPLICATION ASSEMBLY

(71) Applicant: David Morales, Bronxville, NY (US)

(72) Inventor: David Morales, Bronxville, NY (US)

( * ) Notice: Subject to any disclaimer, the term of this patent is extended or adjusted under 35 U.S.C. 154(b) by 0 days.

(21) Appl. No.: 16/175,969

(22) Filed: Oct. 31, 2018

(51) Int. Cl.
*B43K 5/02* (2006.01)
*A45D 34/04* (2006.01)
*B05B 11/00* (2006.01)

(52) U.S. Cl.
CPC ..... *A45D 34/042* (2013.01); *B05B 11/3042* (2013.01); *B05B 11/3046* (2013.01); *B05B 11/3047* (2013.01); *A45D 2200/055* (2013.01)

(58) Field of Classification Search
CPC ..... A45D 34/042; A45D 2200/055; B05B 11/3042; B05B 11/3046; B05B 11/3047
USPC ..... 401/188 R
See application file for complete search history.

(56) References Cited

U.S. PATENT DOCUMENTS 4,371,098 A * 2/1983 Nozawa ..... B05B 11/0059 137/853
5,687,878 A * 11/1997 Smith ..... B05B 11/3001 222/96
5,988,443 A * 11/1999 Smith ..... B05B 11/3001 222/96
6,009,887 A 1/2000 Hertel
6,105,819 A * 8/2000 Ho ..... G09F 19/08 222/131
6,210,057 B1 4/2001 Yannaci
6,247,862 B1 6/2001 Garza
6,279,778 B1 * 8/2001 Ho ..... B05B 11/0005 222/321.7
D493,570 S 7/2004 Phillips
D497,451 S 10/2004 Hajianpour
7,168,873 B2 1/2007 Shawan
D599,055 S 8/2009 Daum
8,382,727 B1 2/2013 Martin
9,211,559 B2 * 12/2015 Law ..... B05B 11/0072
9,308,550 B1 4/2016 Hajianpour

* cited by examiner

*Primary Examiner* — Jennifer C Chiang

(57) ABSTRACT

A lotion application assembly includes a fluid pump having a plunger movably coupled to an intake tube. The fluid pump is removably coupled to a lotion bottle having the intake tube being immersed in lotion contained in the lotion bottle. A plurality of sliding balls is each slidably positioned on the intake tube such that each of the sliding balls is immersed in the lotion when the fluid pump is removably coupled to the lotion bottle. Each of the sliding balls retains an amount of lotion thereon when the fluid pump is removed from the lotion bottle. In this way each of the sliding balls can deposit the lotion onto a user's skin when the intake tube is rubbed on the user's skin. A fixed ball is coupled to the intake tube thereby inhibiting the plurality of sliding balls from sliding off of the intake tube.

5 Claims, 3 Drawing Sheets

LOTION APPLICATION ASSEMBLY

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to application devices and more particularly pertains to a new application device for applying lotion from a lotion bottle onto a user's skin.

BRIEF SUMMARY OF THE INVENTION

An embodiment of the disclosure meets the needs presented above by generally comprising a fluid pump has an intake tube and a plunger is movably coupled to the intake tube. The fluid pump is removably coupled to a lotion bottle having the intake tube being immersed in lotion contained in the lotion bottle. A plurality of sliding balls is each slidably positioned on the intake tube such that each of the sliding balls is immersed in the lotion when the fluid pump is removably coupled to the lotion bottle. Each of the sliding balls retains an amount of lotion thereon when the fluid pump is removed from the lotion bottle. In this way each of the sliding balls can deposit the lotion onto a user's skin when the intake tube is rubbed on the user's skin. A fixed ball is coupled to the intake tube thereby inhibiting the plurality of sliding balls from sliding off of the intake tube.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
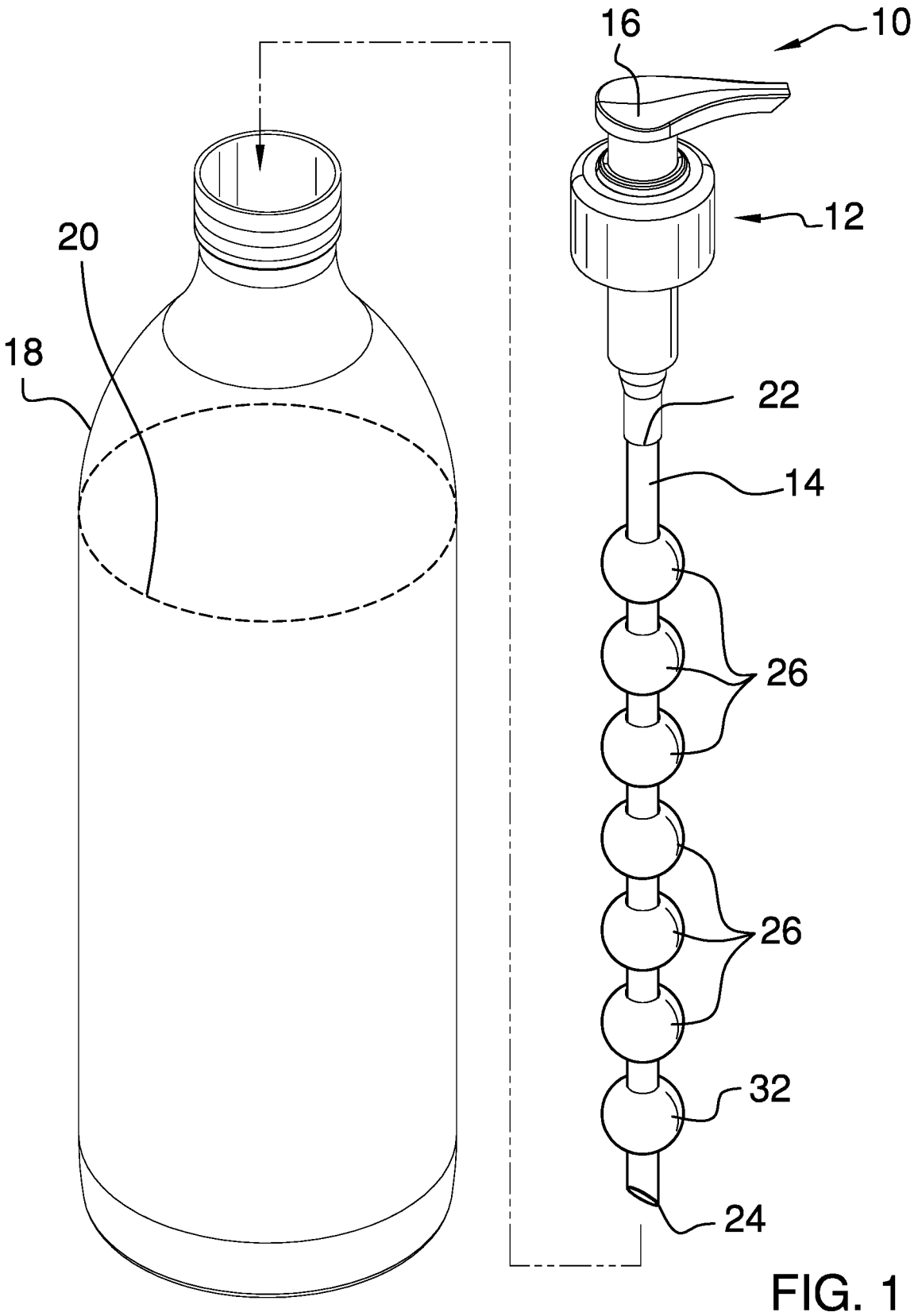
FIG. 1 is a perspective view of a lotion application assembly according to an embodiment of the disclosure.
Figure 2:
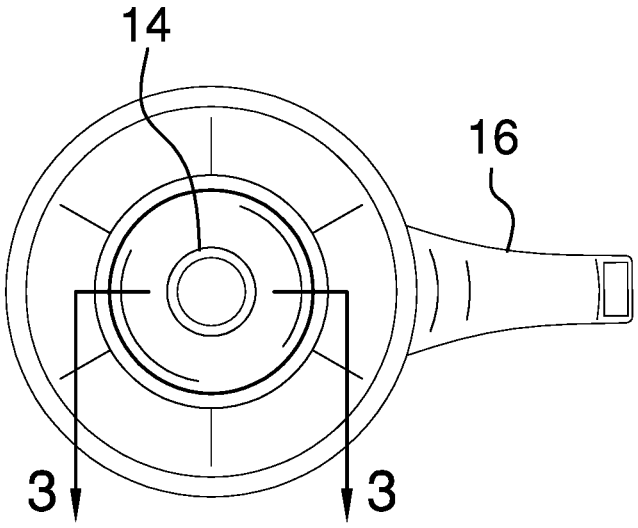
FIG. 2 is a bottom view of an embodiment of the disclosure.
Figure 3:
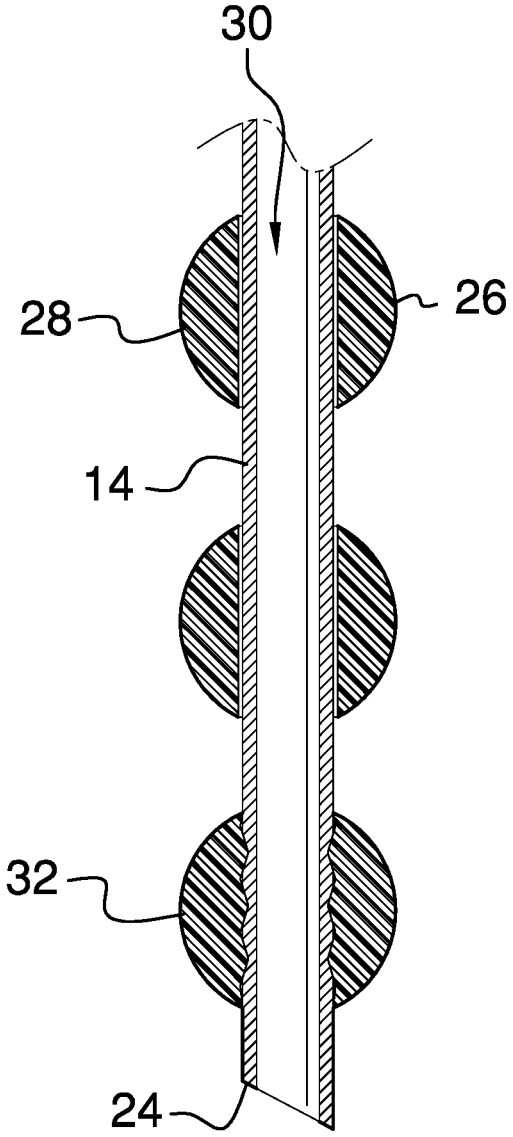
FIG. 3 is a cross sectional view taken along line 3-3 of FIG. 2 of an embodiment of the disclosure.
Figure 4:
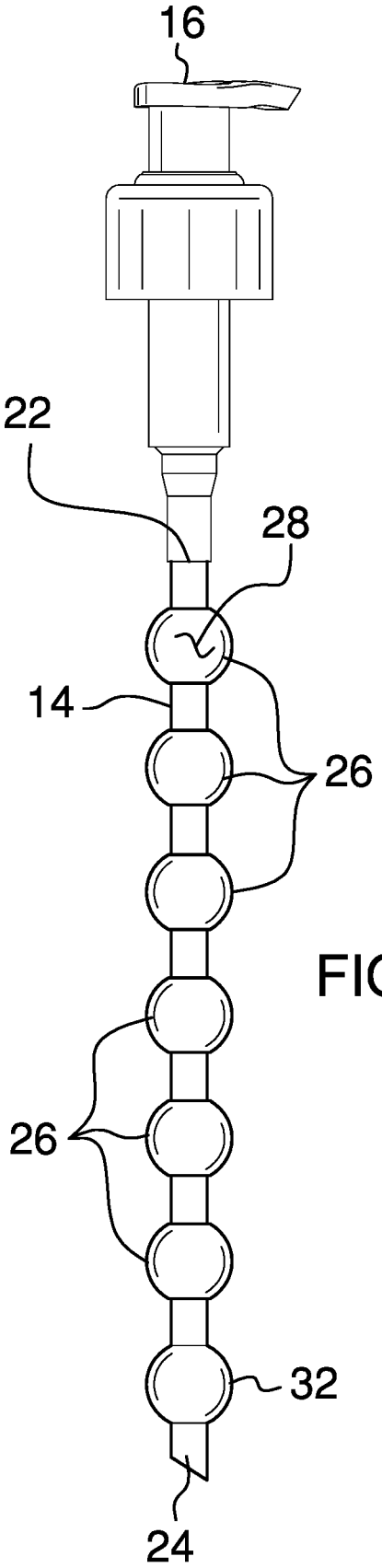
FIG. 4 is a right side view of an embodiment of the disclosure.
Figure 5:
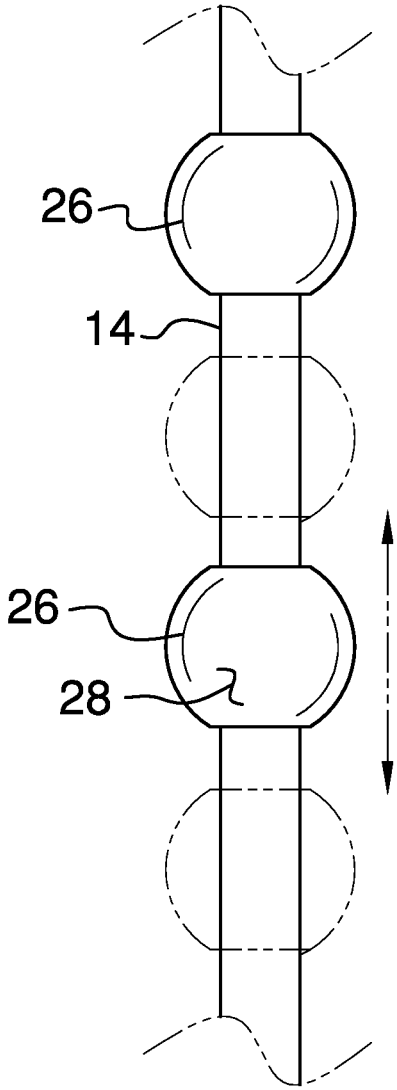
FIG. 5 is a perspective view of an embodiment of the disclosure showing sliding balls being slid along an intake tube.

With reference now to the drawings, and in particular to FIGS. 1 through 5 thereof, a new application device embodying the principles and concepts of an embodiment of the disclosure and generally designated by the reference numeral 10 will be described.

As best illustrated in FIGS. 1 through 5, the lotion application assembly 10 generally comprises a fluid pump 12 that has an intake tube 14 and a plunger 16 that is movably coupled to the intake tube 14. The fluid pump 12 is removably coupled to a lotion bottle 18 having the intake tube 14 being immersed in lotion 20 contained in the lotion bottle 18. The intake tube 14 has a proximal end 22 and a distal end 24 with respect to the plunger 16. Additionally, the fluid pump 12 may be a manually operated fluid pump of any conventional design that is commonly associated with lotion bottles, liquid soap bottles and other fluid dispensing bottles. The lotion 20 in the bottle may be any viscous solution that is non toxic to human skin.

A plurality of sliding balls 26 is each slidably positioned on the intake tube 14. Thus, each of the sliding balls 26 is immersed in the lotion 20 when the fluid pump 12 is removably coupled to the lotion bottle 18. Each of the sliding balls 26 retains an amount of lotion 20 thereon when the fluid pump 12 is removed from the lotion bottle 18. In this way each of the sliding balls 26 deposits the lotion 20 onto a user's skin when the intake tube 14 is rubbed on the user's skin.

Each of the sliding balls 26 has an outer surface 28 and the outer surface 28 of each of the sliding balls 26 has an aperture 30 extending therethrough. Additionally, the aperture 30 extends fully through a respective sliding ball 26 and the intake tube 14 extends through the aperture 30 in each of the sliding balls 26. Thus, each of the sliding balls 26 slides freely between the distal end 24 and the proximal end 22 of the intake tube 14. A fixed ball 32 is coupled to the intake tube 14 thereby inhibiting the plurality of sliding balls 26 from sliding off of the intake tube 14. The intake tube 14 extends through the fixed ball 32 and the fixed ball 32 is spaced upwardly from the distal end 24 of the intake tube 14.

In use, the fluid pump 12 is removed from the lotion bottle 18 thereby facilitating an amount of lotion 20 to be retained on each of the sliding balls 26 and the fixed ball 32. Thus, the intake tube 14 can be rubbed on the user's skin thereby facilitating the lotion 20 on the sliding and fixed ball 32*s* to deposit the lotion 20 on the user's skin. Moreover, the lotion 20 serves to lubricate the sliding balls 26 on the intake tube 14 thereby inhibiting the sliding balls 26 to freely move at all times. The fluid pump 12 can be removably coupled to additional lotion bottle 18*s*, or any other bottle containing a viscous fluid for that matter, thereby facilitating the sliding balls 26 to apply a variety of different viscous fluids to the user's skin.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A lotion application assembly being configured to apply lotion on a user's skin, said assembly comprising:

a fluid pump having an intake tube and a plunger being movably coupled to said intake tube, said fluid pump being removably coupled to a lotion bottle having said intake tube being immersed in lotion contained in the lotion bottle;

a plurality of sliding balls, each of said sliding balls being slidably positioned on said intake tube such that each of said sliding balls is immersed in the lotion when said fluid pump is removably coupled to the lotion bottle, each of said sliding balls retaining an amount of lotion thereon when said fluid pump is removed from the lotion bottle wherein each of said sliding balls is configured to deposit the lotion onto a user's skin when said intake tube is rubbed on the user's skin; and a fixed ball being coupled to said intake tube thereby inhibiting said plurality of sliding balls from sliding off of said intake tube.

2. The assembly according to claim 1, wherein:

said intake tube having a proximal end and a distal end with respect to said plunger; and each of said sliding balls having an outer surface, said outer surface of each of said sliding balls having an aperture extending therethrough having said aperture extending fully through a respective ball.

3. The assembly according to claim 2, wherein said intake tube extends through said aperture in each of said sliding balls such that each of said sliding balls slides freely between said distal end and said proximal end of said intake tube.

4. The assembly according to claim 2, wherein said fixed ball has said intake tube extending therethrough, said fixed ball being spaced from said distal end of said intake tube.

5. A lotion application assembly being configured to apply lotion on a user's skin, said assembly comprising:

a fluid pump having an intake tube and a plunger being movably coupled to said intake tube, said fluid pump being removably coupled to a lotion bottle having said intake tube being immersed in lotion contained in the lotion bottle, said intake tube having a proximal end and a distal end with respect to said plunger;

a plurality of sliding balls, each of said sliding balls being slidably positioned on said intake tube such that each of said sliding balls is immersed in the lotion when said fluid pump is removably coupled to the lotion bottle, each of said sliding balls retaining an amount of lotion thereon when said fluid pump is removed from the lotion bottle wherein each of said sliding balls is configured to deposit the lotion onto a user's skin when said intake tube is rubbed on the user's skin, each of said sliding balls having an outer surface, said outer surface of each of said sliding balls having an aperture extending therethrough having said aperture extending fully through a respective ball, said intake tube extending through said aperture in each of said sliding balls such that each of said sliding balls slides freely between said distal end and said proximal end of said intake tube; and a fixed ball being coupled to said intake tube thereby inhibiting said plurality of sliding balls from sliding off of said intake tube, said fixed ball having said intake tube extending therethrough, said fixed ball being spaced from said distal end of said intake tube.

* * * * *